US006075489A

United States Patent [19]

Sullivan

[11] Patent Number: 6,075,489

[45] Date of Patent: Jun. 13, 2000

[54] COLLAPSIBLE ANTENNA

[75] Inventor: Jonathan L. Sullivan, Lincoln, Nebr.

[73] Assignee: Centurion Intl., Inc., Lincoln, Nebr.

[21] Appl. No.: 09/150,454

[22] Filed: Sep. 9, 1998

[51] Int. Cl.[7] ..... H01Q 1/24

[52] U.S. Cl. ..... 343/702; 343/895; 343/901

[58] Field of Search ..... 343/702, 729, 343/862, 895, 900, 901; H01Q 1/24

[56] References Cited

U.S. PATENT DOCUMENTS

| | | | |
|---|---|---|---|
| 3,803,627 | 4/1974 | Schuscheng | 343/903 |
| 4,205,319 | 5/1980 | Gasparaitis et al. | 343/792 |
| 4,760,401 | 7/1988 | Imazeki | 343/702 |
| 4,772,895 | 9/1988 | Garay et al. | 343/895 |
| 4,849,767 | 7/1989 | Naitou | 343/745 |
| 4,867,698 | 9/1989 | Griffiths | 439/317 |
| 5,079,558 | 1/1992 | Koike | 343/702 |
| 5,177,492 | 1/1993 | Tomura et al. | 343/702 |
| 5,204,687 | 4/1993 | Elliot et al. | 343/702 |
| 5,218,370 | 6/1993 | Blaese | 343/702 |
| 5,245,350 | 9/1993 | Sroka | 343/702 |
| 5,300,940 | 4/1994 | Simmons | 343/749 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/702 |
| 5,446,469 | 8/1995 | Makino | 343/702 |
| 5,467,096 | 11/1995 | Takamoro et al. | 343/702 |
| 5,469,177 | 11/1995 | Rush et al. | 343/702 |
| 5,479,178 | 12/1995 | Ha | 343/702 |
| 5,594,457 | 1/1997 | Wingo | 343/702 |
| 5,646,635 | 7/1997 | Coskson et al. | 343/702 |
| 5,659,889 | 8/1997 | Cockson | 455/575 |

FOREIGN PATENT DOCUMENTS

| | | |
|---|---|---|
| 747990A1 | of 0000 | European Pat. Off. . |
| 6252621 | of 0000 | Japan . |
| 685519 | of 0000 | Japan . |

OTHER PUBLICATIONS

"Lightweight Trap Antennas—Some Thoughts" by Doug DeMaw, Jun. 1983.

*Primary Examiner*—Don Wong
*Assistant Examiner*—Shih-Chao Chen
*Attorney, Agent, or Firm*—Zarley, McKee, Thomte Voorhees & Sease; Dennis L. Thomte

[57] ABSTRACT

A retractable antenna is provided for a wireless communication device such as a wireless modem, two-way radio, cellular telephone, etc., wherein the extended length of the antenna is greater than the height of the telephone housing. The antenna includes components which are slidably mounted with respect to one another so that the antenna may be collapsed and retracted within the telephone housing.

12 Claims, 2 Drawing Sheets

COLLAPSIBLE ANTENNA

BACKGROUND OF THE INVENTION

1. Field of the Invention

The present invention relates to a method of reducing the length of an antenna when it is in the retracted or stored position and then being able to lengthen the antenna when in the extended user position.

2. Description of the Related Art

Cellular telephones and other electronic and communications devices continue to be designed into smaller packages. Electronic technologies are being pushed to reduce the size of every component associated with these devices to enable the overall size of the package to become smaller, lighter weight and more user-friendly, without allowing a degradation of electrical or mechanical performance. With few exceptions, wireless devices require an external antenna to function properly. Generally speaking, the longer the antenna is, the better it will perform for several reasons. One reason is that less energy will be absorbed by the user's body if the active antenna radiating element is further from the user. Another reason is that the antenna will electrically decouple from the transceiver if it is further away from the device. Yet another reason is that in some cases if the antenna is made at the ½ wave length instead of the traditional ¼ wave length, it will be less affected by the metallic chassis, printed circuit board or other metallic components in the transceiver. Traditional antennas reduce the electrical length of the antennas to allow them to fit into the housing when retracted. Another traditional approach is to allow the coil to protrude from the top of the housing when the antenna is retracted.

SUMMARY OF THE INVENTION

A retractable antenna for a wireless communication device such as a wireless modem, two-way radio, cellular telephone, etc., is described and includes a first metal connector which is threadably secured to the receptacle at the upper end of the telephone housing with the receptacle being RF coupled to the telephone circuitry. An elongated cable antenna is utilized and has a first metal contact at its lower end and a second metal contact at its upper end. A first electrically conductive tube member is slidably mounted on the lower end of the cable antenna and is RF coupled thereto through the first metal contact. A second electrically conductive tube member is slidably mounted on the upper end of the cable antenna and is RF coupled thereto through the second metal contact. A helical antenna is positioned at the upper end of the second tube member and is RF coupled thereto. A conventional insulating cap means encloses the helical antenna. Further, an insulating sheath means encloses the cable element between the first and second tube members. The cable antenna and the first and second tube members are slidably movable from a fully retracted position to a fully extended position. When the cable antenna is in its fully retracted position, the helical antenna is positioned closely adjacent the upper end of the telephone housing. The first metal contact is positioned adjacent the upper end of the first tube member when the cable antenna is in its fully extended position and is positioned adjacent the lower end of the first tube member when the cable antenna is in its fully retracted position. The second metal contact is positioned adjacent the lower end of the second tube member when the cable element is in its fully retracted position and is positioned adjacent the upper end of the second tube member when the cable antenna is in its fully retracted position.

It is therefore a principal object of the invention to provide a retractable collapsible antenna.

Further, it is a principal object of the invention to provide a retractable antenna for a cellular telephone which is cost-effective to manufacture and which is easy to manufacture.

Yet another object of the invention is to provide a retractable antenna which may be retrofitted to existing designs.

Yet another object of the invention is to provide a retractable antenna for a small cellular telephone which permits longer radiators to be utilized.

Still another object of the invention is to provide a retractable antenna for a cellular telephone wherein the antenna, when extended, has a length greater than the height of the telephone housing.

These and other objects will be apparent to those skilled in the art.

DESCRIPTION OF THE PREFERRED EMBODIMENT

Figure 1:
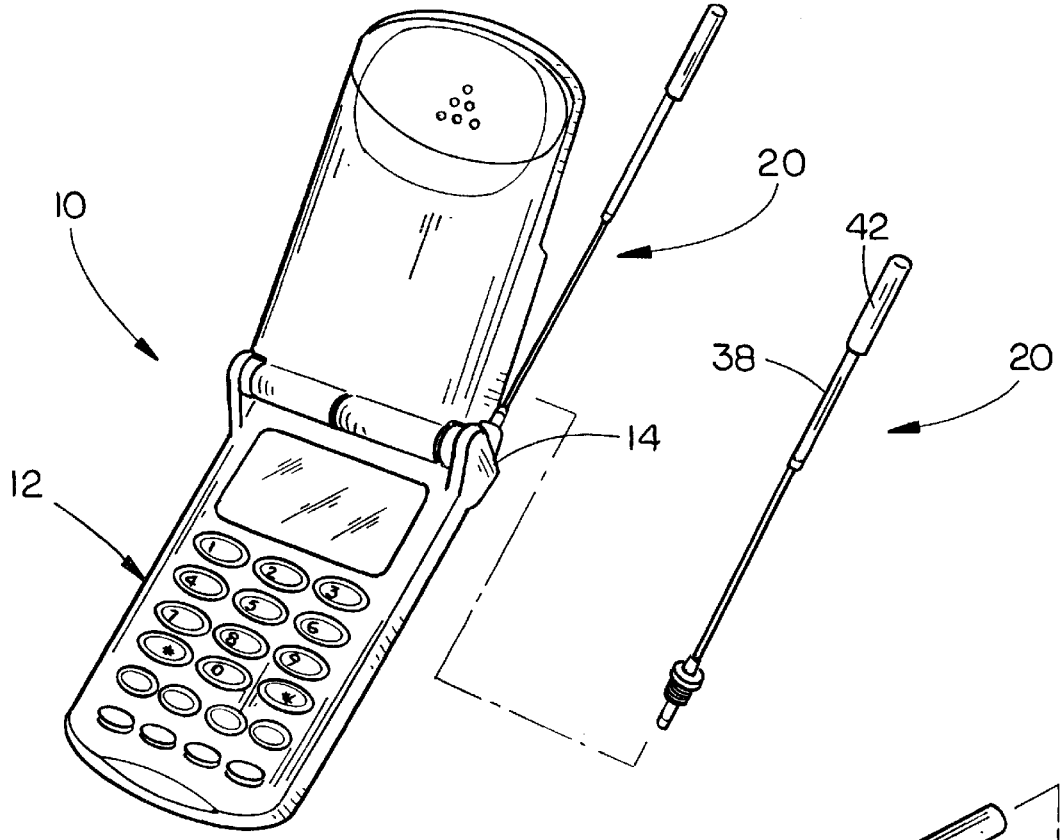
FIG. 1 is a perspective view of the antenna of this invention and which illustrates the antenna mounted on a cellular telephone and which also illustrates the antenna removed therefrom.
Figure 2:
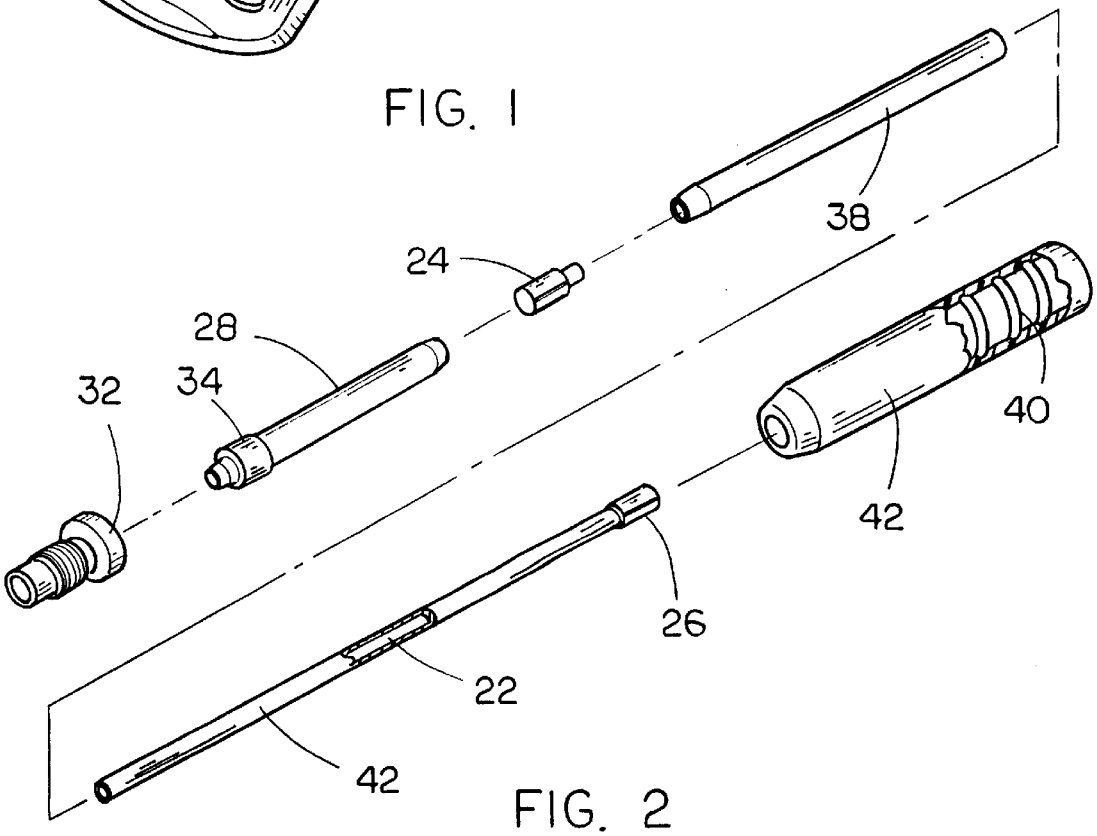
FIG. 2 is an exploded perspective view of the antenna of this invention with portions thereof cut away to more fully illustrate the invention.

The numeral 10 refers to a conventional cellular telephone including a housing 12 which contains conventional circuitry therein. The upper end 14 is provided with a metal receptacle which is RF coupled to the circuitry within the housing 12. Receptacle 16 includes a bore 18 extending therethrough. Although a cellular telephone is illustrated and described, the antenna of this invention may be used with other wireless communication devices such as a modem, two-way radio, etc.

The numeral 20 refers to the retractable antenna of this invention. Antenna 20 includes an elongated cable antenna or radiator 22 which is preferably comprised of a nickel titanium wire. A metal contact 24 is secured to the lower end of the cable antenna 22 while a metal contact 26 is secured to the upper end thereof. Contacts 24 and 26 are RF coupled to the cable antenna 22 in conventional fashion.

Metal contact 24 is slidably received within a first metal tube member 28 having a bore 30 extending therethrough. Contact 24, and cable antenna 22, are slidably received in the bore 30 so that contact 24 may be positioned adjacent the upper end of the tube member 28 or may be positioned adjacent the lower end of tube member 28, as seen in the drawings and as will be described in more detail hereinafter. Tube member 28 is slidably received by the metal conductor 32 which is threadably secured to the receptacle 16 of the housing 12. The exterior surface of tube member 28 includes a stop which limits the upward slidable movement of tube member 28 with respect to connector 32. In some cases, the current (RF) passes from a contact mounted on the circuit board of the telephone circuitry directly to the antenna radiator bypassing the connector 32.

Contact 26 is slidably received by bore 36 of a metal tube member 38, with the contact 26 being RF coupled to the tube member 38. Contact 26 may be slidably moved with respect to tube member 38 from a position wherein contact 26 is positioned adjacent the lower end of tube member 38 to a position where the contact 26 is positioned adjacent the upper end of tube member 38, as seen in the drawings and as will be described in greater detail hereinafter.

The numeral 40 refers to a helical antenna, the lower end of which is RF coupled to the upper end of tube member 38. Helical antenna 40 is enclosed by a conventional insulating cap means 42. Preferably, cable antenna 22 is a ¼ wave antenna as is helical antenna 40. Cable antenna 22 is enclosed by a conventional electrically insulating sheath 42 which extends between the contact 24 and the contact 26.

Figure 3:
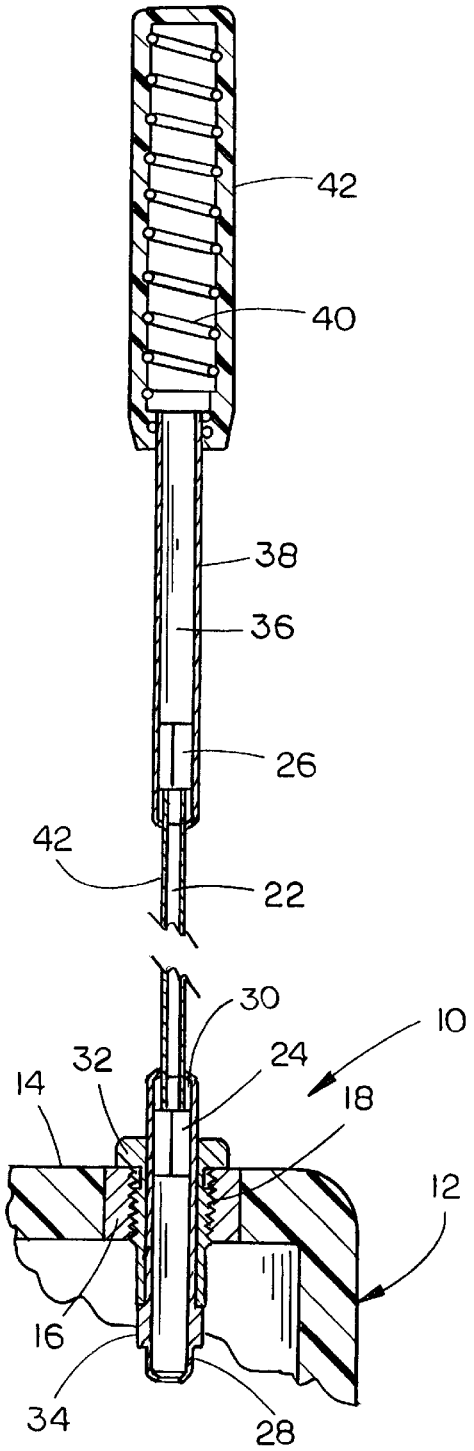
FIG. 3 is a partial longitudinal sectional view of the antenna of this invention in its fully extended position.

When the antenna 20 is in its fully extended position, as illustrated in FIG. 3, tube member 28 is positioned in connector 32 with the stop 34 engaging the lower end of the connector 32 to limit the upward movement of tube member 28 with respect to connector 32. In the position just described, tube member 28 is RF coupled to connector 32 which in turn is RF coupled to the receptacle 16 and the telephone circuitry. When the antenna 20 is in its fully extended position, contact 24 is positioned adjacent the upper end of tube member 26, as seen in FIG. 3. With the antenna in its fully extended position, contact 26 is positioned adjacent the lower end of tube member 38 and is RF coupled thereto. Thus, in the fully extended position illustrated in FIG. 3, the antenna has a considerable length with the overall length of the same being greater than the height of the housing 12 of telephone 10. In the fully extended position, the antenna 20 acts as a ½ wave antenna in as much as the cable antenna 22 and the helical antenna 40 are connected in series.

Figure 4:
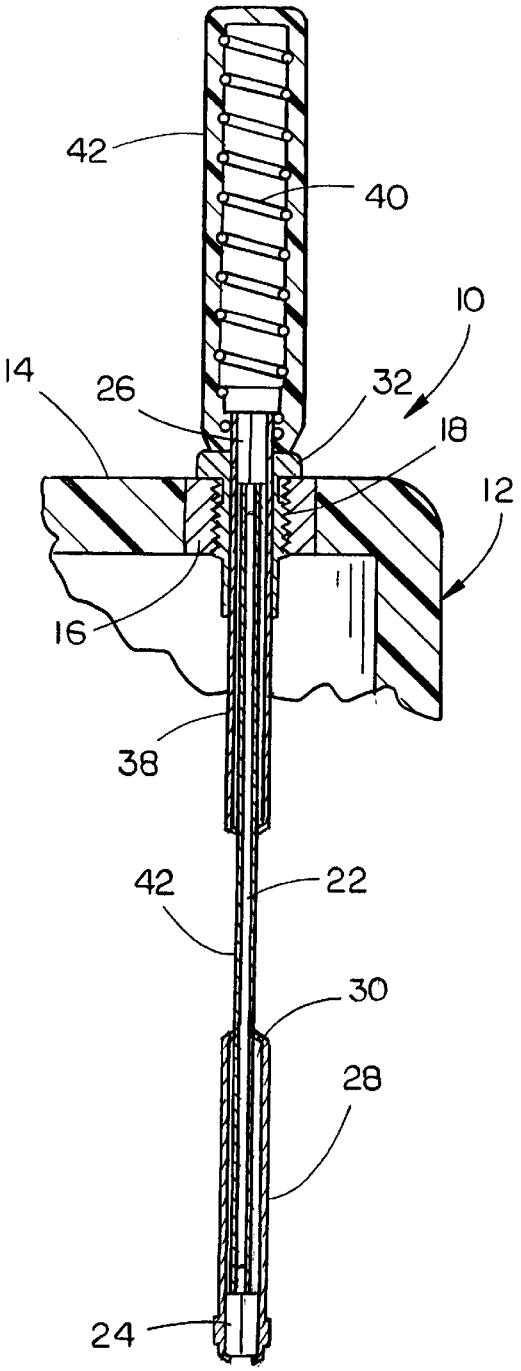
FIG. 4 is a view similar to FIG. 3 except that the antenna is illustrated in its retracted position.

When it is desired to store or retract the antenna 20, the user simply grasps the cap means 42 and pushes the antenna 20 downwardly into the housing 12 of the telephone 10. The downward movement of the antenna 20 continues until the lower end of tube member 28 reaches the lower inner end of the housing 12, at which time further retraction of the antenna causes contact 24 to slidably move downwardly in bore 30 to the position illustrated in FIG. 4. At the same time, tube member 38 continues to move downwardly which causes the contact 26 to slidably move in bore 36 of tube 38 until the contact 26 is positioned adjacent the upper end of tube member 38. In its fully retracted position, the helical antenna 40 is positioned closely adjacent the upper end 14 of the housing 12 which is made possible by the slidable connection between contact 24 and tube member 28, the slidable connection between contact 26 and tube member 38, as well as the movement of the cable antenna 22 downwardly into the interior of the housing 12 of telephone 10.

When the antenna is in its fully retracted position, the helical antenna 40 will be in circuit due to the RF connection between tube member 38 and the connector 32.

Thus it can be seen that a novel retractable antenna has been provided which enables a longer antenna to be used than would otherwise be possible. The antenna of this invention is easy to manufacture and is cost-effective to build. The antenna of this design may be retrofitted to existing designs and will be durable in use.

Thus it can be seen that the antenna of this invention accomplishes at least all of its stated objectives.

What is claimed is:

1. A retractable antenna for a wireless communication device including a housing having a receptacle at the upper end thereof which is RF coupled to the circuitry of the device and which has a first bore extending therethrough, comprising:

a metal connector having an upper end, a lower end, and a second bore extending therethrough;

said metal connector being received by the first bore in the receptacle and being RF coupled thereto;

an elongated cable antenna having upper and lower ends and having a first metal contact at its lower end and a second metal contact at its upper end;

a first, elongated electrically conductive tube member, having upper and lower ends, mounted on the lower end of said cable antenna and being RF coupled thereto;

a second, elongated, electrically conductive tube member, having upper and lower ends, mounted on the upper end of said cable antenna and being RF coupled thereto;

an insulating sheath means enclosing said cable antenna between said first and second tube members;

a helical antenna positioned at the upper end of said second tube member and being RF coupled thereto;

an insulating cap means enclosing said helical antenna;

said cable antenna, and said first and second tube members, being slidably received within said second bore of said metal connector whereby said cable antenna is slidably movable, with respect to the telephone housing, from a fully retracted position to a fully extended position;

said cable antenna and said helical antenna being RF coupled to the receptacle and the telephone circuitry, through said first tube member, when said cable antenna is in its fully extended position;

said helical antenna being RF coupled to said receptacle and the telephone circuitry, through said second tube member, when said cable antenna is in its fully retracted position;

said helical antenna being closely positioned adjacent the upper end of the telephone housing when said cable antenna is in its fully retracted position;

said first metal contact being RF coupled to the lower end of said cable antenna;

said first metal contact being slidably received by said first tube member.

2. The antenna of claim 1 wherein said cable antenna comprises a ¼ wave antenna and wherein said helical antenna comprises a ¼ wave antenna.

3. The antenna of claim 1 wherein said second metal contact is RF coupled to the upper end of said cable antenna and wherein said second metal contact is slidably received by said second tube member.

4. The antenna of claim 1 wherein said first metal contact is positioned adjacent the lower end of said first tube member when said cable antenna is in its said fully retracted position and is positioned adjacent the upper end of said first tube member when said cable antenna is in its fully extended position.

5. The antenna of claim 3 wherein said second metal contact is positioned adjacent the lower end of said second tube member and is positioned adjacent the upper end of said second tube member when said cable antenna is in its said fully retracted position.

6. A retractable antenna for a wireless communication device including a housing having a receptacle at the upper end thereof and which has a first bore extending therethrough, comprising:

a connector having an upper end, a lower end, and a second bore extending therethrough;

said connector being received by the first bore in the receptacle;

an elongated cable antenna having upper and lower ends and having a first metal contact at its lower end and a second metal contact at its upper end;

a first, elongated electrically conductive tube member, having upper and lower ends, mounted on the lower end of said cable antenna and being RF coupled thereto;

a second, elongated, electrically conductive tube member, having upper and lower ends, mounted on the upper end of said cable antenna and being RF coupled thereto;

an insulating sheath means enclosing said cable antenna between said upper end of said first tube member and said lower end of said second tube member;

a helical antenna positioned at the upper end of said second tube member and being RF coupled thereto;

an insulating cap means enclosing said helical antenna;

said cable antenna, and said first and second tube members, being slidably received within said second bore of said first metal connector whereby said cable antenna is slidably movable, with respect to the housing, from a fully retracted position to a fully extended position;

said cable antenna and said helical antenna being RF coupled to the circuitry of the device and the telephone circuitry, through said first tube member, when said cable antenna is in its fully extended position; said helical antenna being RF coupled to the telephone circuitry, through said second tube member, when said cable antenna is in its fully retracted position;

said helical antenna being closely positioned adjacent the upper end of the telephone housing when said cable antenna is in its fully retracted position;

said first metal contact being RF coupled to the lower end of said cable antenna;

said first metal contact being slidably received by said first tube member.

7. The antenna of claim 6 wherein said cable antenna comprises a ¼ wave antenna and wherein said helical antenna comprises a ¼ wave antenna.

8. The antenna of claim 6 wherein said second metal contact is RF coupled to the upper end of said cable antenna and wherein said second metal contact is slidably received by said second tube member.

9. The antenna of claim 6 wherein said first metal contact is positioned adjacent the lower end of said first tube member when said cable antenna is in its said fully retracted position and is positioned adjacent the upper end of said first tube member when said cable antenna is in its fully extended position.

10. The antenna of claim 8 wherein said second metal contact is positioned adjacent the lower end of said second tube member and is positioned adjacent the upper end of said second tube member when said cable antenna is in its said fully retracted position.

11. The antenna of claim 8 wherein said first metal contact is positioned adjacent said upper end of said first tube member when said cable antenna is in its said fully extended position and wherein said first metal contact is positioned adjacent said lower end of said first tube member when said cable antenna is in its said fully retracted position; said second metal contact being positioned adjacent said lower end of said second tube member when said cable antenna is in its said fully extended position; said second metal contact being positioned adjacent said upper end of said second tube member when said cable antenna is in its said fully retracted position.

12. A retractable antenna for a wireless communication device including a housing having a receptacle at the upper end thereof which is RF coupled to the circuitry of the device and which has a first bore extending therethrough, comprising:

a metal connector having an upper end, a lower end, and a second bore extending therethrough;

said metal connector being received by the bore in the receptacle and being RF coupled thereto;

an elongated cable antenna having upper and lower ends and having a first metal contact at its lower end and a second metal contact at its upper end;

a first, elongated electrically conductive tube member, having upper and lower ends, mounted on the lower end of said cable antenna and being RF coupled thereto;

a second, elongated, electrically conductive tube member, having upper and lower ends, mounted on the upper end of said cable antenna and being RF coupled thereto;

an insulating sheath means enclosing said cable antenna between said first and second tube members;

a helical antenna positioned at the upper end of said second tube member and being RF coupled thereto;

an insulating cap means enclosing said helical antenna;

said cable antenna, and said first and second tube members, being slidably received within said second bore of said first metal connector whereby said cable antenna is slidably movable, with respect to the telephone housing, from a fully retracted position to a fully extended position;

said cable antenna and said helical antenna being RF coupled to the receptacle and the telephone circuitry, through said first tube member, when said cable antenna is in its fully extended position;

said helical antenna being RF coupled to said receptacle and the telephone circuitry, through said second tube member, when said cable antenna is in its fully retracted position;

said helical antenna being closely positioned adjacent the upper end of the telephone housing when said cable antenna is in its fully retracted position;

said second metal contact being RF coupled to the upper end of said cable antenna;

said second metal contact being slidably received by said second tube member.

* * * * *